US006612530B1

(12) United States Patent
Kwak et al.

(10) Patent No.: US 6,612,530 B1
(45) Date of Patent: Sep. 2, 2003

(54) DEVICE FOR TETHERED SECUREMENT OF AN ARTICLE OF TOILETRY

(75) Inventors: Sam Yeol Kwak, 40-27 77th St., 2nd Floor, Elmhurst, NY (US) 11373; Jong Kyu Park, Flushing, NY (US)

(73) Assignee: Sam Yeol Kwak, New York, NY (US)

( * ) Notice: Subject to any disclaimer, the term of this patent is extended or adjusted under 35 U.S.C. 154(b) by 0 days.

(21) Appl. No.: 09/659,450

(22) Filed: Sep. 11, 2000

(51) Int. Cl.[7] ..... A47H 1/10

(52) U.S. Cl. ..... 248/317; 211/113; 211/119.009

(58) Field of Search ..... 248/317, 108, 248/320, 323, 327, 328, 560, 235, 297.21, 250; D6/522, 527, 528, 530, 529, 532, 536, 540–542, 545; 222/180, 500, 181.3; 211/118, 113, 119.009, 119.011, 65–66, 60.1; 108/108; 206/77.1

(56) References Cited

U.S. PATENT DOCUMENTS

| | | | | | |
|---|---|---|---|---|---|
| 563,635 | A | | 7/1896 | Wiseman | |
| 706,992 | A | | 8/1902 | Neamann | |
| 1,285,657 | A | * | 11/1918 | Finugan | |
| 1,318,567 | A | | 10/1919 | Key | |
| 1,420,654 | A | * | 6/1922 | Grant | |
| 1,566,732 | A | * | 12/1925 | Carruthers | |
| 1,570,396 | A | * | 1/1926 | Pollock | |
| 1,831,509 | A | * | 11/1931 | Rinehardt | |
| 2,145,142 | A | | 1/1939 | Stout | |
| 2,307,752 | A | | 1/1943 | Anderson | |
| 2,308,771 | A | | 1/1943 | Mooney | |
| D147,221 | S | * | 7/1947 | Sahley | |
| 2,679,709 | A | | 6/1954 | Du Bois | |
| 2,838,209 | A | | 1/1958 | Legman | |
| 2,825,177 | A | | 3/1958 | Nordlof et al. | |
| 2,868,417 | A | | 1/1959 | Legman | |
| 2,883,087 | A | * | 4/1959 | Nichols, Jr. | 222/100 |
| 2,894,639 | A | * | 7/1959 | Caporicci | 211/60.1 |
| 2,934,852 | A | | 5/1960 | Heberling | |
| 3,212,679 | A | | 10/1965 | Schmidt, Jr. | |
| 3,297,288 | A | | 1/1967 | Cardoza | |
| 3,446,468 | A | | 5/1969 | Sakwa | |
| 3,623,641 | A | | 11/1971 | Hansen | |
| 3,693,923 | A | * | 9/1972 | Ayoub et al. | 248/360 |
| 3,894,754 | A | * | 7/1975 | Staats | 248/223 |
| 4,034,851 | A | * | 7/1977 | Barksdale | 206/77.1 |
| 4,095,362 | A | * | 6/1978 | Potter | 248/317 |
| 4,108,314 | A | * | 8/1978 | Racca | 211/113 |
| 4,141,452 | A | * | 2/1979 | Martin et al. | 211/60.1 |
| 4,227,668 | A | * | 10/1980 | Ernst | 248/317 |
| 4,480,939 | A | * | 11/1984 | Upton | 206/77.1 |
| D276,862 | S | | 12/1984 | Upton | |
| 4,523,357 | A | * | 6/1985 | Widditsch | 248/317 |
| 4,538,784 | A | * | 9/1985 | O'Flanagan | 248/244 |
| 4,768,743 | A | | 9/1988 | Frost | |
| 4,770,303 | A | * | 9/1988 | Boyd | 211/205 |
| 4,811,475 | A | * | 3/1989 | Morton, Jr. | 248/317 |
| 4,895,331 | A | * | 1/1990 | Nehls | 248/245 |

(List continued on next page.)

*Primary Examiner*—Daniel P. Stodola
*Assistant Examiner*—Jennifer E. Novosad
(74) *Attorney, Agent, or Firm*—Jordan and Hamburg LLP

(57) ABSTRACT

A toiletry holder includes a support bracket mountable to a support, such as a wall or other fixed structure. A tether is fixed to the support bracket, for example, at a position therealong spaced apart from the support. A fastener is carried on the tether in a position thereof distant from its point of attachment with the support bracket. The fastener is adapted for removable securement of an article of toiletry, for example, soap, toothpaste, etc., such that the toiletry article may be held in tethered securement to the support bracket and maintained in a position in which it can be isolated from contact with surrounding environmental surfaces. Optionally, the tether is resiliently extensible, permitting the article of toiletry to be moved to a distance farther from the support bracket than a position occupied thereby when the article of toiletry simply hangs from the support bracket by the tether.

20 Claims, 2 Drawing Sheets

U.S. PATENT DOCUMENTS 4,913,319 A * 4/1990 Root ..... 222/135
5,148,926 A * 9/1992 Cocuzzo et al. ..... 211/118
D341,510 S * 11/1993 Lieberman ..... D6/527
5,351,346 A * 10/1994 Hodges, Jr. ..... 4/605
5,366,125 A * 11/1994 Procido ..... 224/202
5,417,397 A * 5/1995 Harnett ..... 248/309.4
5,511,756 A * 4/1996 Spradling ..... 248/316.7
5,582,581 A * 12/1996 Horton ..... 206/77.1
5,642,871 A * 7/1997 Repert et al. ..... 248/686
5,657,953 A * 8/1997 Smith ..... 248/217.1
6,098,566 A * 8/2000 Metcalf ..... 248/235
6,241,388 B1 * 6/2001 Terramani ..... 206/581

* cited by examiner

DEVICE FOR TETHERED SECUREMENT OF AN ARTICLE OF TOILETRY

BACKGROUND OF THE INVENTION

The present invention relates to a toiletry holder, and more particularly to a holder adapted for removable securement of an article of toiletry for tethered handling thereof.

Many toiletries are used at a sink, bath or shower location, and can sometimes clutter such vicinity when rested thereon. In a bath area, the toiletry, such as, for example, a bar of soap, may additionally become easily misplaced or dropped into inaccessible locations, such as outside the tub or shower, at a time when the user is unable to easily locate or retrieve the article due to blocked vision or slippery conditions. Moreover, a bar of soap placed in a soap dish or on a countertop of a bathroom or kitchen will generally be in prolonged contact with water, causing the contact surface of the bar to melt, resulting in product waste and an undesirable sensation on the part of the user when the bar is picked up for use. In addition, a dropped toiletry may become contaminated and/or damaged by unintentional contact with environmental surfaces.

Toiletry holding devices which are presently available, although addressing some of the problems associated with toiletry use, are, however, subject to limitations. For example, toiletry products having a means for securement are generally restricted to the specific toiletry product's useful life, and must be purchased with the securing means at a higher cost. In addition, the user is limited exclusively to the particular products which are available with such securing means. Furthermore, these toiletry holding devices generally have locating means without a specialized means for securement to a fixed structure.

Adequate steps have therefore not heretofore been taken to avoid such undesirable circumstances. Consequently, a product which optimizes product yield of a toiletry, or which prevents waste and exposure of various toiletries to unwanted contact with bacterial and/or chemical contaminants, water, dirt, etc., would be highly desirable.

Accordingly, it is an object of the invention to provide a toiletry holder which overcomes the drawbacks of the prior art.

It is a further object of the invention to provide a toiletry holder which permits the toiletry to be held in an accessible location, and used without detachment from the holder.

It is yet a further object of the invention to provide a toiletry holder which is easily installed in a desired location, and which provides reliable and reusable service.

It is still a further object of the invention to provide a toiletry holder in a form which is economical and simple in design, and adapted to versatile use with a variety of toiletries.

SUMMARY OF THE INVENTION

In accordance with these and other objects of the invention, there is provided a toiletry holder which includes a support bracket mountable to a support, such as a wall or other fixed structure. A tether is fixed to the support bracket, advantageously at a position therealong spaced apart from the support. A fastener is carried on the tether in a position thereof distant from its point of attachment with the support bracket. The fastener is adapted for removable securement of an article of toiletry, for example, soap, toothpaste, etc., such that the toiletry may be held in tethered securement to the support bracket and advantageously isolated from contact with surrounding environmental surfaces when hanging from the support bracket by the tether.

The tether is advantageously resiliently extensible, permitting the toiletry to be moved to a distance farther from the support bracket than a position occupied thereby when the toiletry simply hangs from the support bracket by the tether.

In accordance with an advantageous embodiment, the toiletry to which the holder is directed is a tube of toothpaste, and the toiletry holder is configured to permit sparing amounts of product remaining in a substantially exhausted tube to be expelled. The support bracket is configured as a support arm of elongated dimension. A narrow slot is provided in the support arm along a longitudinal extent thereof which approximates the thickness of the tube when flattened. The end of the toothpaste tube distant from the opening thereof is inserted in the slot and the tube is moved longitudinally in a direction which forces the contents remaining therein in a direction of the opening.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
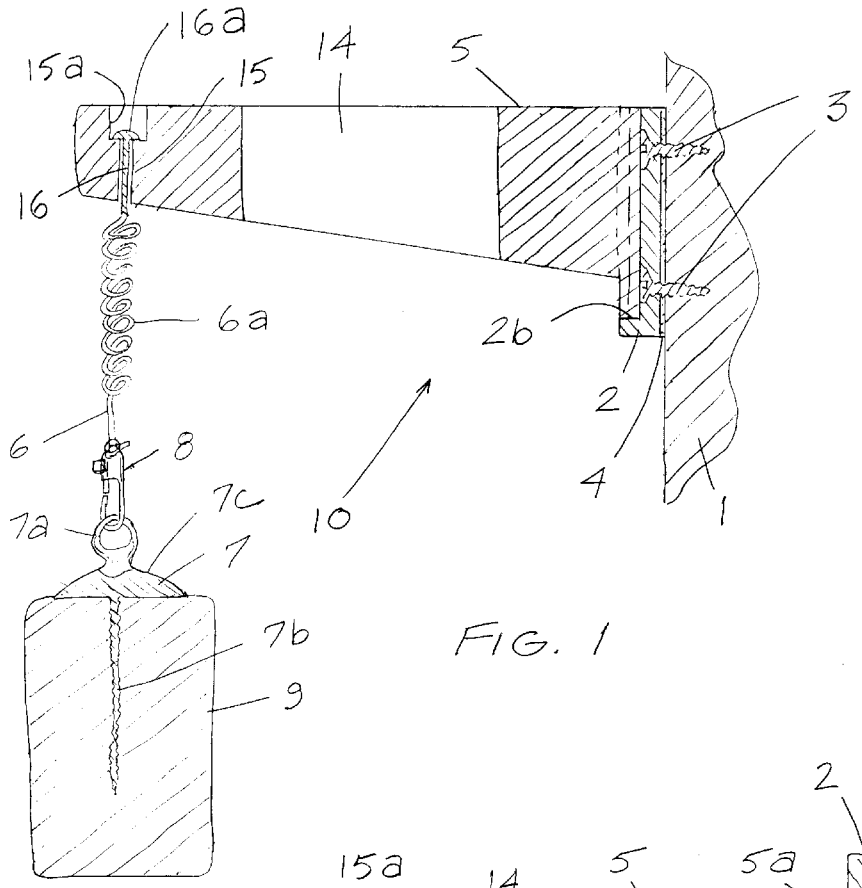
FIG. 1 is a side elevation of a toiletry holder, shown in partial cross-section, in accordance with an embodiment of the invention, in which the depicted toiletry is a bar of soap.
Figure 2:
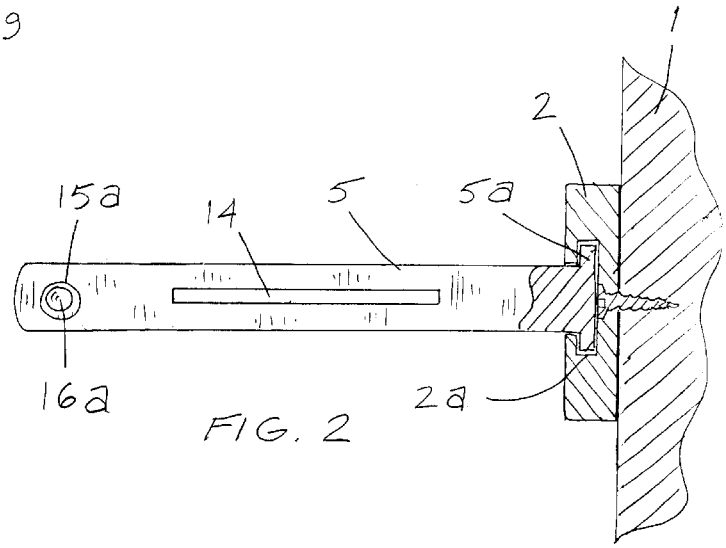
FIG. 2 is a plan view of the embodiment of FIG. 1.

Referring now to FIGS. 1 and 2, a toiletry holder in accordance with an embodiment of the invention is depicted, and which is generally designated by the reference numeral 10. The toiletry holder 10 is mountable to a support 1, such as, for example, a wall, advantageously by surface mounting, as depicted. Any other fixed structure may alternatively serve as the support. In accordance with the advantageous embodiment of FIGS. 1 and 2, an optional structural adaptation permits removal of a major portion of the toiletry holder 10 after fixed mounting thereof to the support 1. This is provided in the form of a mounting bracket 2 which is received in permanent mounted fashion to the surface of support 1. The mounting bracket 2 is fixed to the support 1 by suitable means, for example mechanical fasteners, such as screws 3, and/or by adhesive 4 applied by the user or supplied as a ready to use pressure activated backing. For illustration purposes only, the mounting bracket 2 redundantly employs both adhesive and mechanical fastening approaches. A support bracket is provided, which extends a distance horizontally outward of the support 1, and which, in the depicted embodiment, is configured in the form of a support arm 5 having elongated dimension and which includes a base portion 5*a* structurally configured to slidably engage a complementary receiving channel 2*a* in the mounting bracket 2 (best seen in FIG. 2). In accordance with the depicted example, the support arm 5 is slidably coupled with the mounting bracket 2 by reception from above, and is lowered until the base portion 5*a* bottoms against a stop 2*b* (see FIG. 1) at a lower terminal end of the receiving channel 2*a*. Although not depicted, structure may be optionally provided, for example in a known manner, which can be moved to a position which will block upward slidable movement of the support arm 5 once mountably received to the mounting bracket 2, thereby acting as a stop. In accordance with such advantageous embodiment, the support arm 5, along with all elements attached thereto and which are detailed more fully below, can be removed from the support 1 as desired for cleaning, etc., while only the mounting bracket 2 having a low profile remains permanently mounted. It is noted however, that the mounting bracket 2 and the support bracket (support arm 5 in the embodiment) can be integrated into a single component without departure from the intended scope of the invention. In such event, if so desired by the user, for example for economic reasons, since such integration of parts results in the requirement of less components, the resultant support bracket would be secured directly to the support in a permanent fashion, and would not be easily removable/replaceable.

The toiletry holder 10 further includes a tether 6 attached to the support arm 5, and advantageously arranged to hang downward therefrom. The a lower end of the tether 6 is movable in lateral directions relative to the vertical hanging position. In the event the tether 6 is substantially inflexible, such freedom of movement may be accomplished by means of a pivot provided at or below a point, of attachment to the support arm 5 (not shown). Advantageously, however, the tether 6 is comprised of a flexible material which permits bending thereof over at least a length portion thereof. More advantageously, the tether 6 is extensible, permitting its elongation in response to applied force in excess of gravity. This is accomplished in the depicted example conveniently by providing the tether 6, which is comprised of a suitable resilient material, for example rubber, elastic polymer or metal, with a coiled spring portion 6*a*. In a simplified embodiment, the tether 6 may simply be a straight rubber band which is stretchable. Alternatively, other means may be employed to accomplish the advantages attendant this embodiment. For example, although not depicted, the tether 6 could be wound at least partially about a retractable, rotationally biased spool carried on the support bracket 6 which would be unwound in response to applied pulling force, and returned to a wound condition when the force is released. Any other mechanism, known or otherwise, which would accomplish such goal, is also deemed to be within the intended scope of the invention.

In the depicted embodiment of FIGS. 1 and 2, the tether 6 is attached to the support arm 5 in the following manner. Support arm 5 includes an opening 15 through which at least a length portion of the tether 6 located adjacent an end of the tether 6 is slidably received. An engagement structure 16 is provided at an end of the tether 6, at least a portion of which defines an enlarged portion 16*a* sized larger than a narrowest dimension of the opening 15 to prevent passage of the enlarged portion 16*a* of the engagement structure 16 through the opening 15, thereby also preventing detachment of the tether 6 from the support arm 5. As shown in the example of FIGS. 1 and 2, the opening advantageously includes a widened portion 15*a* for at least partially accommodating the enlarged portion 16*a* of the engagement structure 16. In the case of the depicted embodiment, when mounted, a longitudinal extent of the support arm 5 extends horizontally, and the opening extends vertically such that dislodgement of tether 6 from the support arm 5 is prevented when the tether 6 is acted upon by gravity or other downward force.

A toiletry mounting fastener 7 suitable for removably holding an article of toiletry is carried on the tether 6, advantageously at a downwardly oriented terminal end thereof. In the depicted example, a clasp 8 is optionally fixed to the tether 6, which allows various other type toiletry mounting fasteners particularly suited for use with different types of toiletries to be readily substituted for the toiletry mounting fastener 7 shown in FIG. 1. For example, the toiletry mounting fastener 7 of FIG. 1 is suited for use in holding a bar of soap 9 in tethered securement to the support arm 5. The toiletry mounting fastener 7 includes a ring portion 7*a* for captive engagement with the clasp 8, a screw portion (or ridged pin) 7*b* for threadably piercing (or skewering) the bar of soap 9, and a cap portion 7*c* which acts as a stop when the screw portion has penetrated an intended amount.

The invention is not intended to be limited in any manner to the precise configuration of the toiletry mounting fastener 7 as shown and described. It is recognized that any number of suitable fastening mechanisms will be equally suited to use as a temporary toiletry securement device, and such use is contemplated to be within the scope of the invention. In addition, as noted above, other toiletry mounting fasteners are envisioned which would be suited to use for holding particular types of toiletry articles other than soap bars.

Figure 3:
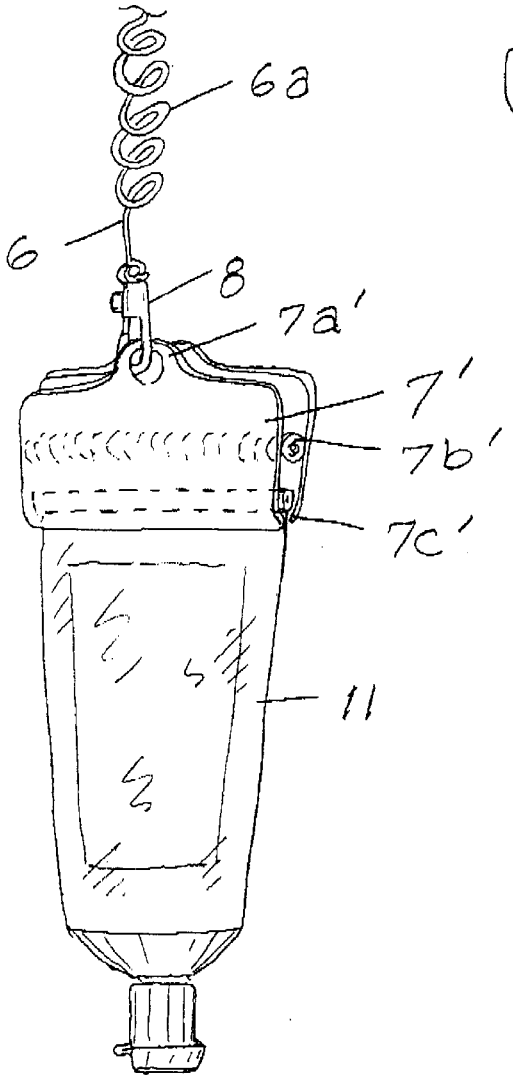
FIG. 3 is a partial side perspective view of a variation of the embodiment of FIGS. 1 and 2 in which the depicted toiletry is a tube of toothpaste.
Figure 4:
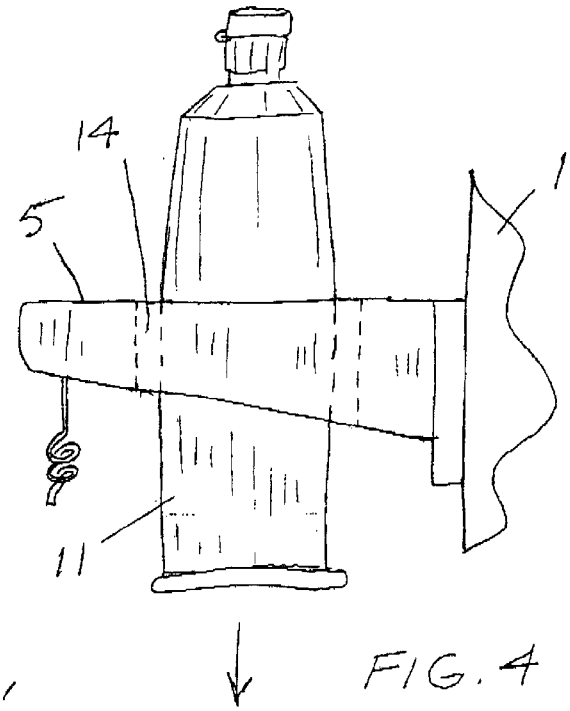
FIG. 4 is an instructional side elevation depicting use of a feature of the toiletry holder directed to efficient expulsion of sparing amounts of toothpaste remaining in a substantially used tube.

One example of another toiletry holder embodiment, directed to use with a tube of toothpaste, is shown in FIG. 3. In this embodiment, which is analogous in structure to the previously described embodiment of FIGS. 1 and 2, differs only with respect to the toiletry mounting fastener. In the embodiment, a toiletry mounting fastener 7' is provided in the form of a clamp which includes a ring portion 7*a*' for captively engaging the clasp 8, a spring 7*b*' for providing biasing force in a clamping direction, and clamp jaws 7*c*' for firmly engaging an end of a tube of toothpaste 11 and holding same securely. In accordance with an optional feature of the invention which is intended for use in connection with the embodiment directed to use with a tube of toothpaste, as depicted in FIG. 3, a design configuration facilitates expulsion of sparing amounts of toothpaste remaining in a substantially used tube, thereby making maximum use of the contents thereof for optimized product yield. As shown in FIGS. 1 and 2, a slot 14 is provided in the support arm 5 dimensioned to approximate a thickness of the toothpaste tube 11 when entirely flattened. Use of the slotted feature of the support arm 5 is described with reference to FIG. 4. An end of the almost exhausted tube of toothpaste 11 opposite the opening end thereof is inserted into the slot 14 and the tube is moved in the direction of the arrow such that any remaining toothpaste is urged within the tube towards the opening. In such manner, virtually all of the toothpaste remaining in the tube can be expelled in a simple, reliable manner.

It is deemed advantageous to configure the toiletry holder such that the toiletry is spaced apart from surrounding support structure and any other environmental structures when in a normally hanging condition to prevent contamination by water, dirt, or chemical and/or biological agents. It is also noted that although a wall is disclosed as the support surface, a horizontal or other arranged surface can be used with a suitably configured support bracket with comparable effectiveness and without departure from the intended scope of the invention.

Any suitable materials having sufficient strength and rigidity can be used for the mounting and support brackets, as well as the toiletry mounting fasteners, such as for example, aluminum, plastics, etc., which can be molded or fabricated using convention production techniques. It is further noted that if so desired, the toiletry mounting fastener can at least in part be incorporated into the design of the toiletry itself by the manufacturer thereof, such that structure of the toiletry could engage cooperative structure carried on the tether. Alternatively, the toiletry could include the tether extending therefrom, and which would be suitable for removable attachment to the mounted support bracket.

Use of the above described toiletry holder permits soap to be easily located at a sink, or in a shower or bath, and used while in tethered attachment to a support, and simply released after use without misplacement, thus obviating the problem of locating a soap dish with the eyes closed. When used with toothpaste, the tube advantageously hangs with the opening side at a lowest position. This feature permits the toothpaste to naturally flow by the influence of gravity in a direction of the opening, facilitating the dispensing of toothpaste during each use.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A toiletry holder, comprising:

a tether;

a support bracket mountable to a support structure;

an engagement structure carried on said tether at an end thereof;

a fastener, for holding an article of toiletry, carried at a position along said tether spaced apart from said end at which said engagement structure is carried; and said support bracket including an opening through which at least a length portion of said tether located adjacent to said end thereof is slidably received, said opening defining first and second portions, said first portion being dimensioned narrower than said second portion, said engagement structure including an enlarged portion which is sized larger than said first portion of said opening in said support bracket to prevent passage of said enlarged portion through said opening, said second portion of said opening being sized large enough to at least partially accommodate said enlarged portion of said engagement structure.

2. A toiletry holder according to claim 1, wherein said support bracket is configured as a support arm having an elongated shape.

3. A toiletry holder according to claim 2, wherein:

said support bracket includes a longitudinal extent which extends horizontally when the support bracket is mounted to the support structure; and said opening extends vertically when said support bracket is mounted such that dislodgement of said tether from said support bracket is prevented when the tether is acted upon by a downward force.

4. A toiletry holder according to claim 1, wherein said tether is flexible.

5. A toiletry holder according to claim 1, wherein said tether is extensible in response to applied pulling force.

6. A toiletry holder according to claim 5, wherein said tether includes a coiled spring portion.

7. A toiletry holder according to claim 1, further comprising a mounting bracket securable to the support structure in fixed engagement therewith, said support bracket being removably securable to said mounting bracket.

8. A toiletry holder according to claim 1, wherein said tether is comprised of rubber.

9. A toiletry holder according to claim 1, wherein said fastener includes one of a pin and screw for penetrating a bar of soap.

10. A toiletry holder according to claim 1, wherein said fastener includes a clamp for clampingly engaging an article of toiletry, said clamp being spring biased in a clamping direction.

11. A toiletry holder according to claim 1, further comprising a clasp carried on said tether for permitting exchange of said fastener with another fastener as desired.

12. A toiletry holder according to claim 1, wherein said bracket includes a contact surface adapted for conformable contact with an engaged surface of the support structure, said toiletry holder further comprising pressure activated adhesive applied to said contact surface.

13. A toiletry holder, comprising:

a tether having a length extending between a first end and a second end;

an engagement structure carried on said tether at said first end thereof;

a fastener, securable to an article of toiletry, carried on said tether at said second end thereof; and a support bracket mountable to a support structure, said support bracket including an opening defining a passageway extending from a first side of said support bracket to a second side of said support bracket opposite to said first side through which at least a portion of said length of said tether located adjacent to said first end thereof slidably passes with said first side of said support bracket facing said engagement structure and said second side facing said fastener, at least a portion of said engagement structure being of a size larger than at least a portion of said passageway to prevent passage of said engagement structure through said passageway from said first side to said second side of said support bracket, whereby a portion of said length of said tether carrying said fastener extends from said second side of said support bracket with said engagement structure in engaged contact with said support bracket.

14. A toiletry holder according to claim 13, wherein said passageway narrows from said first side to said second side, a first portion of said passageway extending from said first side being sized large enough to at least partially accommodate said at least a portion of said engagement structure.

15. A toiletry holder according to claim 13, wherein said support bracket includes a contact surface adapted for conformable contact with an engaged surface of the support structure, said toiletry holder further comprising pressure activated adhesive applied to said contact surface.

16. A toiletry holder according to claim 13, wherein said support bracket includes at least a portion configured as a support arm having an elongated shape extending along a longitudinal axis.

17. A toiletry holder according to claim 16, wherein said passageway runs crosswise to said longitudinal axis of said support bracket, such that when said support bracket is mounted to the support structure with said longitudinal axis arranged horizontally, said engagement structure carried on said tether captively limits slidable downward movement of said tether which passes through said passageway.

18. A toiletry holder according to claim 17, wherein:

said support arm includes a mounting end which faces said support structure when mounted thereto and a terminal end opposite thereto; and said opening is formed in a position along said support arm closer to said terminal end than to said mounting end.

19. A toiletry holder according to claim 13, wherein said tether is extensible in response to an applied pulling force.

20. A toiletry holder according to claim 19, wherein said tether includes a coiled spring portion.

* * * * *